United States Patent [19]

Keranen et al.

[11] Patent Number: 4,701,578

[45] Date of Patent: Oct. 20, 1987

[54] MULTI-POSITION SELECTOR SWITCH ASSEMBY MEANS

[75] Inventors: John J. Keranen, Sussex; Scot F. Peret, Milwaukee; David R. Stewart, Brookfield, all of Wis.

[73] Assignee: Eaton Corporation, Cleveland, Ohio

[21] Appl. No.: 894,166

[22] Filed: Aug. 7, 1986

[51] Int. Cl.[4] ..... H01H 9/20

[52] U.S. Cl. ..... 200/5 B; 200/5 E; 200/5 EB; 206/223

[58] Field of Search ..... 200/5 R, 5 B, 5 C, 5 D, 200/5 E, 5 EA, 5 EB, 5 OC, 5 A, 11 TW; 206/223

[56] References Cited

U.S. PATENT DOCUMENTS

| | | | |
|---|---|---|---|
| 2,519,899 | 8/1950 | Gaynor | 200/5 E |
| 2,550,623 | 4/1951 | Teruzzi | 200/5 E X |
| 3,100,822 | 8/1963 | Vermeulen | 200/5 EB |
| 3,858,018 | 12/1974 | Walley | 200/5 EB X |
| 4,190,749 | 2/1980 | Erickson et al. | 206/223 X |
| 4,303,811 | 12/1981 | Parkinson | 200/5 A |
| 4,544,810 | 10/1985 | Butterworth | 200/5 B |

*Primary Examiner*—J. R. Scott

*Attorney, Agent, or Firm*—D. A. Rowe; L. G. Vande Zande

[57] ABSTRACT

Four different versions of multi-position selector switches can be assembled from a kit of parts by selecting various combinations of the parts and assembling them into a housing consisting of an insulating case and cover. Inventory of parts is reduced by mutual use of some parts in two or more versions. The possible selector switch versions are a three position selector switch having three momentary pushbuttons for selectively closing two normally open contacts and opening a normally closed contact a two-position slector switch having two momentary pushbuttons for selectably closing a normally open contact or opening a normally closed contact, a three-position selector switch having three maintainable pushbuttons for selectively closing two normally open contacts and opening the same, and a three-position selector switch having three pushbuttons including a momentary pushbutton and two maintainable pushbuttons for selectively closing two normally open contacts and for opening the maintained contact. The third and fourth versions described above which have maintainable pushbuttons comprise one or two sliding interlock members having cam surfaces cooperating with respective pushbuttons for preventing depression of more than one pushbutton at a time, and a holding plate for releasably retaining the pushbuttons depressed until the latter are returned to an extended position by one of the sliding interlock members.

20 Claims, 20 Drawing Figures

MULTI-POSITION SELECTOR SWITCH ASSEMBY MEANS

BACKGROUND OF THE INVENTION

Multi-positioned selector switches have been known heretofore. For example, E. M. Butterworth U.S. Pat. No. 4,544,810, dated Oct. 1, 1985, shows an interlocking pushbutton selector switch having two alternately operable "ON" pushbuttons with interlocking means to allow operation of only one of these pushbuttons at a time, latch means for maintaining either of these pushbuttons in its depressed position and a central "OFF" pushbutton for restoring the depressed "ON" pushbutton to its normal position. The "ON" pushbuttons have helical compression springs for returning them to their normal positions. A single movable contact spring has left and right end portions for contacting double-throw or single-throw stationary contacts. The holding latch mechanism and "OFF" pushbutton may be removed to provide space for a transformer and pilot light, at the same time converting the "ON" pushbuttons to momentary type. While interlocking pushbutton selector switches of this type have been useful for their intended purposes, this invention relates to improvements thereover.

SUMMARY OF THE INVENTION

An object of the invention is to provide an improved multi-position selector switch assembly means.

A more specific object of invention is to provide a kit of parts that can be assembled in various combinations within a housing to provide any one of a plurality of different versions of multi-postion selector switches with some of the functional parts being mutually used in the different versions, thereby to reduce the inventory of parts that are required.

Another specific object of the invention is to provide the aforementioned kit of parts such as to enable assembly thereof into a multi-position momentary selector switch having two normally open contacts and one normally closed contact and being able to selectively connect a common contact to any one of three different pairs of stationary contacts for FORWARD, STOP and REVERSE motor control.

Another specific object of the invention is to provide the aforementioned kit of parts such as to enable assembly thereof into a two-position start-stop momentary selector switch having a normally closed contact and a normally open contact.

Another specific object of the invention is to provide the aforementioned kit of parts such as to enable assembly thereof into a three-position maintained selector switch of the single-pole double-throw type.

Another specific object of the invention is to provide the aforementioned kit of parts such as to enable assembly thereof into a multi-position switch having momentary, off and maintained positions.

Other objects and advantages of the invention will hereinafter appear.

BRIEF DESCRIPTION OF THE DRAWINGS

FIG. 1 is an elevational view with the cover of FIGS. 19 and 20 removed showing the momentary pushbuttons and contacts of this first version of selector switch.

FIG. 2 is a fragmentary cross-sectional view of the housing of the switch of FIG. 1 taken substantially along line 2—2 thereof showing the means for connecting the cover to the switch case.

FIG. 3 is a side view of the center pushbutton, the front view of which is shown in FIG. 1.

FIG. 4 is a left side view of the left end pushbutton, the front view of which is shown FIG. 1.

FIG. 5 is the top view of the movable contact which is shown in front view in FIG. 1.

FIG. 6 is a top view of one of the normally open stationary contacts of FIG. 1.

FIG. 7 is a front view of the two electrically connected normally closed contacts of FIG. 1.

FIGS. 8–10, together with the cover shown in FIGS. 19 and 20, show a second version of the selector switch, that is, a two-position START-STOP momentary selector switch of the motor control type or the like.

FIG. 8 is an elevational view of this second version of switch with the cover shown in FIGS. 19 and 20 removed, showing the two pushbuttons and the contacts arrangement therein.

FIG. 9 is a fragmentary cross-sectional view of the switch of FIG. 8 taken substantially along line 9—9 thereof to show the manner of securing the cover to the switch case.

FIG. 10 is a left-side view of the plug placed in the unused pushbutton space.

FIGS. 11–16 show a third version of the selector switch, that is, a three-position maintained selector switch that may be used for motor reversing, HAND, OFF, AUTO operation or the like.

FIG. 11 is a front elevational view with the cover removed of the three-position maintained selector switch showing an assembled view of the three pushbuttons, the two slider cams, the holding member, the two operating levers and the movable and stationary contacts, with the switch being shown in its off position.

FIG. 12 is a fragmentary cross-sectional view taken substantially along the line 12—12 of FIG. 11 to show the relationship of the slider cams and holding member as well as the means for securing the cover to the switch.

FIG. 13 is a side view of one of the three maintainable pushbuttons of the switch of FIG. 11.

FIG. 14 is a front view of one of the slider cams used in the switch of FIG. 11 also showing in broken lines how this slider cam may be modified for use in the selector switch of FIG. 17.

FIG. 15 is a front view of the holding member used in the switch of FIG. 11.

FIG. 16 is a top view of one of the two movable contact operating levers used in the switch of FIG. 11.

FIGS. 17 and 18, together with the cover shown in FIGS. 19 and 20, show a fourth version of the multi-position selector switch, that is, a MOMENTARY-OFF-AUTO maintained selector switch which may be used for specialiized electrical system control such as TEST, OFF, AUTO or the like.

FIG. 19 is an internal elevational view of the cover for the switch case used in all four versions of the multi-position selector switch.

FIG. 20 is a top view of the cover of FIG. 19.

DESCRIPTION OF THE PREFERRED EMBODIMENTS

Figure 1:
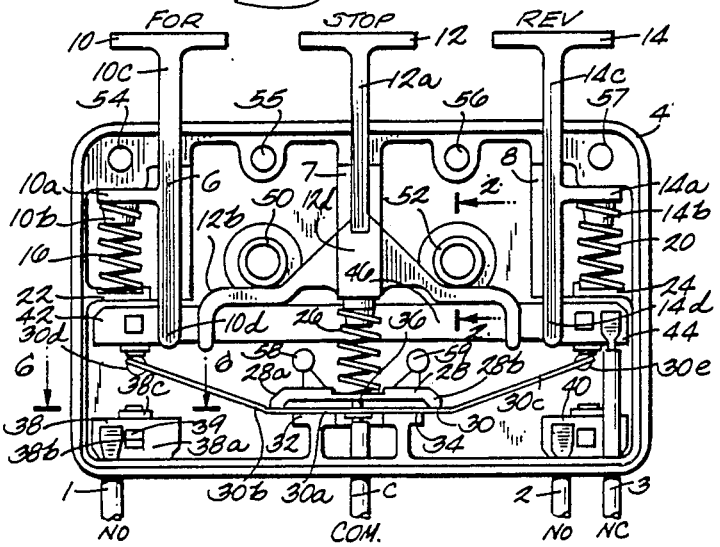
FIGS. 1–7, 19 and 20 show a first version of a multi-position selector switch, that is, a three-position selector switch capable of connecting any combination of two out of three stationary contacts to a common contact for FORWARD, STOP and REVERSE motor operation.

Referring to FIG. 1, there is shown an assembled front elevational view, with the cover removed, of the first version of three-position momentary selector switch. As shown therein, this switch is provided with a common terminal or wire C and three switched terminals or wires 1, 2 and 3, terminals 1 and 2 being connected to normally open contacts and terminal 3 being connected to normally closed contacts. This switch is provided with a molded insulating case having integrally formed on its upper in ner wall three spaced pairs of spaced vertical ribs 6, 7 and 8 with the ribs of each pair thereof providing a channel therebetween to guide the vertical motion of momentary pushbuttons 10, 12 and 14. Left and right end pushbuttons and 14, or if the switch is used vertically, upper and lower pushbuttons 10 and 14 are alike and generally T-shaped at their upper portions having an upper flat surface for engagement by the finger of the user and each is provided with a lateral arm 10*a*, 14*a* having a downward lug 10*b*, 14*b* thereon for retaining the upper end of a helical return spring 16, 20, respectively. The lower ends of these compression springs 16 and 20 abut the upper surfaces of respective shelves 22 and 24 integrally molded at substantially the centers of the left and right ends of case 4, the upper surfaces of these shelves having suitable shallow recesses for retaining the lower ends of these compression springs.

Figure 4:
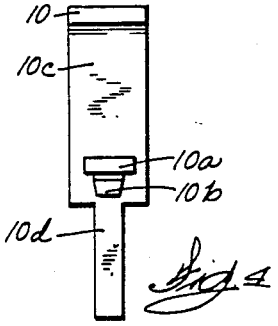

As shown in FIG. 4 which is a left side view of pushbutton 10, for example, the right side of pushbutton 14 having the same appearance, the central portion 10*c* of this pushbutton 10 is generally flat and has a width sufficient to allow the rear edge thereof to slide in the channel between ribs 6 in the case whereas the lower end portion 10*d* is narrower to provide clearance for the stationary contacts hereinafter described. As shown in FIG. 1, pushbutton 14 has similar parts 14*a*–14*d* except that it is rotated 180 degrees with respect to pushbutton 10.

Figure 3:
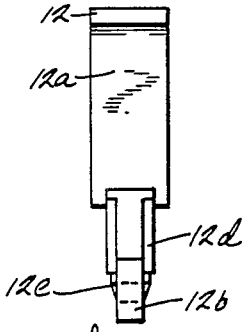

Center pushbutton 12 is also provided with a generally flat central portion 12*a* having a width sufficient that its rear edge will slide in the channel between ribs 7 in the case. The lower portion of pushbutton 12 is provided with dual contact operating means. This means comprises a pair of left and right offset legs 12*b* and 12*c* that extend adjacent the lower ends of pushbuttons 10 and 14 for operating both ends of the movable contact concurrently. As shown in to FIG. 3, the lower portion 12*d* of pushbutton 12 is narrower the central portion 12*a* thereof so as to provide clearance for the connector between the normally closed contacts as hereinafter more fully described. The lower center tip of pushbutton 12 is provided with a round lug 12*e* for receiving the upper end of a helical return spring 26 while the lower end of this helical compression spring abuts down against the upper surface of a shelf 28 which also forms a part of the mounting means for movable contact 30 hereinafter described, this shelf 28 being integrally molded at the lower portion of and within case 4. The upper surface of shelf 28 is provided with a suitable shallow recess for retaining the lower end of compression spring 26.

Figure 5:
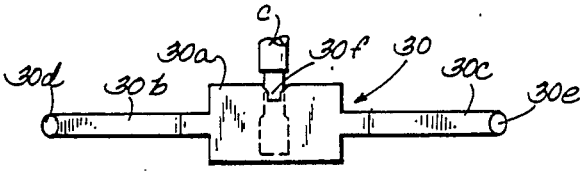

Movable contact 30 is of the single pole doublethrow type. As shown in FIG. 5, it is a generally flat spring of the leaf spring type having a generally rectangular main or terminal portion 30*a* having left and right contacting portions 30*b* and 30*c* extending in opposite directons rections from the ends thereof and integral therewith, these contacting portions being bent to upward angles of about 20 degrees as shown in FIG. 1 and having contact tips 30*d* and 30*e* of good electrically conductive metal on both sides of the tips thereof which engage the stationary contacts as hereinafter described. Movable contact 30 also has a flared-entry notch 30*f* at the rear edge centrally of its center rectangular portion 30*a* as shown in FIG. 5 for locking the movable contact against unwanted lateral movement in case 4 as hereinafter described.

Case 4 is provided with integrally molded mounting means for movable contact 30 which allows easy and fast assembly of the movable contact in the case by merely pressing it therein. For this purpose, case 4 is provided with the aforementioned integrally molded shelf 28 having downwardly turned left and right ends 28*a* and 28*b* as shown in FIG. 1 and a pair of spaced lower shelves 32 and 34 closely below and within the downwardly turned ends 28*a* and 28*b* of upper shelf 28. To securely hold movable contact 30 between shelves 32 and 34 on the one hand and downwardly turned tips 28*a* and 28*b* of upper shelf 28 on the other hand, the upper surfaces of shelves 32 and 34 are arranged on substantially the same plane as the lower surfaces of downwardly turned ends 28*a* and 28*b* of upper shelf 28. With this arrangement, it is necessary to flex or upwardly bias the central portion of movable contact 30 in order to insert it between the aforementioned shelves whereafter it may be pressed down into its place. Case 4 is also provided with a short vertical rib 36 between shelves 28, 32 and 34 which is embraced by notch 30*f* of the movable contact when the movable contact is pressed into its place in the case thereby to prevent lateral movement of the movable contact.

Figure 6:
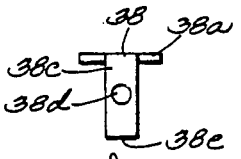

This switch is also provided with a plurality of stationary contacts electrically connected to terminals or wires 1, 2 and 3. of these stationary contacts is like that shown in FIGS. 1 and 6. Since all of these stationary contacts are alike, stationary contact 38 will be described in detail. As shown therein, stationary contact 38 has a mounting plate 38*a* having a square hole 38*b* therein through which an integrally molded projection 39 in the case extends and which may be heat formed over plate 38*a* to secure the stationary contact in the case. As shown in FIG. 1, stationary contact 38 is secured to the inner back wall of the case. Stationary contact 38 also has a forwardly projecting narrow contact strip 38*c* bent perpendicular from its mounting plate 38*a* which has secured to the upper center surface thereof a good electrically conducting contact tip 38*d* as shown in FIG. 6 for engagement by the lower contact tip 30*d* of the associated movable contact. Terminal or wire 1 is electrically connected as by welding to mounting plate 38*a* of stationary contact 38 as shown in FIG. 1.

Common terminal or wire C is electrically connected as by welding to central rectangular portion 38*a* of movable contact 30 as shown in FIG. 5.

Figure 7:
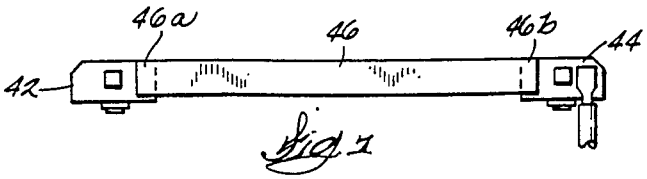

Stationary contact 40 at the lower right-hand portion of switch case 4 is similar to stationary contact 38 and is similarly mounted in the switch case so that it need not be further described. As will be apparent, stationary contacts 38 and 40 are of the normally open type with respect to movable contact tips 30*d* and 30*e*. In this switch there is also provided a normally closed stationary contact consisting of a pair of stationary contacts 42 and 44 electrically connected to one another by a connector strap 46 as shown in FIGS. 1 and 7. The opposite ends of connector strap 46 are preferably welded to the mounting plates of stationary contacts 42 and 44 at points 46*a* and 46*b* as shown in FIG. 7 with the stationary contacts 42 and 44 being spaced correctly apart from one another so that this assembly can then be placed with the plastic projections in the case projecting through the square holes in these stationary contacts and heat formed thereover to securely mount this stationary contact assembly in the case as hereinbefore described in connection with stationary contact 38. Since stationary contacts 42 and 44 are connected together by connector strap 46, only one terminal or wire 3 is required and is welded to the mounting plate of stationary contact 44 and extends out through a hole in the case as do the other wires 1, 2 and C.

Figure 2:
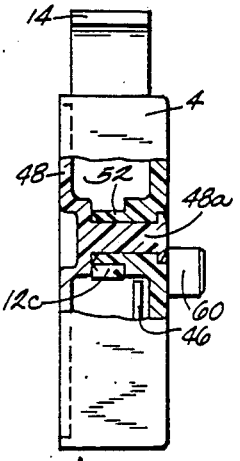
Figure 19:
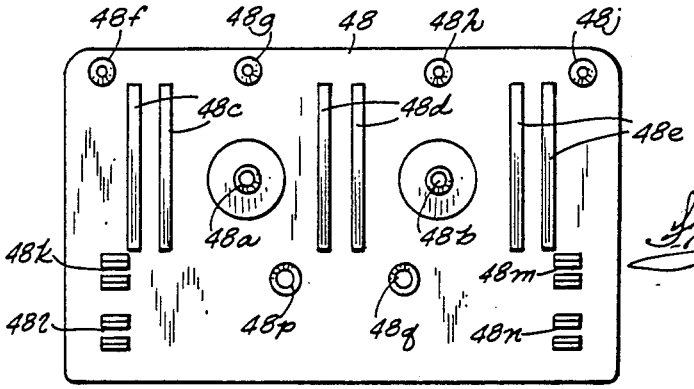
Figure 20:
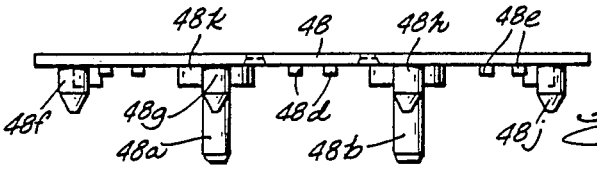

As shown in FIGS. 2, 19 and 20, cover 48 is provided with a pair of round pins 48*a* and 48*b* that extend inwardly from its inner surface and are inserted through respective round holes in projections 50 and 52 to permanently secure the cover to the case. As shown in FIG. 19, the inner surface of cover 48 is provided with three spaced pairs of spaced apart and vertically arranged ribs 48*c*, 48*d* and 48*e* that are directly opposite rib pairs 6, 7 and 8 in the case so as to provide channels therebetween along which the three pushbuttons slide thereby to guide the pushbuttons, in their operations. The inner surface of cover 48 is also provided adjacent its upper edge with four integrally molded pins 48*f*, 48*g*, 48*h* and 48*j* which extend into respective and complementary blind holes 54–57 in the case to securely position the cover with respect to the case. Cover 48 is also provided with four pairs of stationary contact retaining lugs 48*k*–48*n* with these pairs of lugs being located with respect to the four stationary contacts 38, 40, 42 and 44. The tips of each pair of these lugs such as 48*n* are flared to facilitate receipt of the forward end portion 38*e* shown in FIG. 6 between the lugs of the pair and retaining the same securely therein. Cover 48 is also provided with a pair of countersunk holes 48*p* and 48*q* for receiving the forward end portions of the two integrally molded pins 58 and 59 in the case, these holes being countersunk on the inner surface of the cover to facilitate entry of these pins when the cover is assembled on the case. Mounting means such as three spaced projections 60 on the back of the case are used to mount the switch in an enclosure or the like.

A practical use or application of the switch of FIG. 1 could be for forward of reverse operation of an electrical device such as a motor and stopping the same. Depressing pushbutton 10 provides forward operation of the motor. For this purpose, common terminal C is connected to forward terminal 1 while power line terminal 3 remains connected to common terminal C. On the other hand if pushbutton 14 is depressed, reverse operation of the motor will be attained. For this purpose, common terminal C will be connected to reverse terminal 2 while line terminal 3 remains connected to common terminal C. If pushbutton 12 is depressed, line terminal 3 will be disconnected to disconnect power from the switch. This switch may be arranged such that depression of pushbutton 12 will only separate the movable contacts from the normally closed stationary contacts 42 and 44 and will not close them with normally open stationary contacts 38 and 40. However, even if the movable contacts should close to normally open contacts 38 and 40, nothing will happen because line terminal 3 has been disconnected thereby disconnecting power from the switch.

Figure 8:
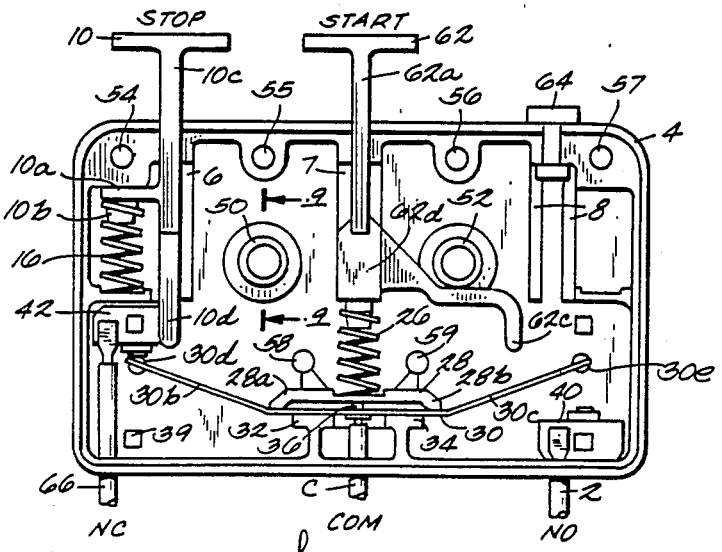
Figure 9:
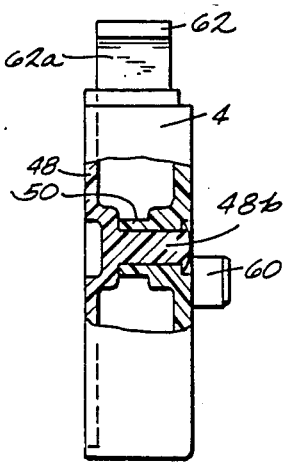
Figure 10:
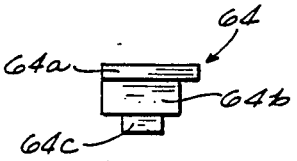

Referring to FIGS. 8–10, there is shown a second version of the multi-position selector switch which is a two-position START-STOP selector switch. In FIGS. 8–10, reference characters like those in FIGS. 1–7 have been used for like parts. as shown therein, this version of switch has a case 4 and a cover 48 closing the open front of the case like those in the first version of the switch. Inside the case, there if also provided a momentary pushbutton 10 and a return spring 16 like those in FIG. 1. Furthermore, there is provided a stationary normally open contact 40 connected to terminal or wire 2 similar to that in FIG. 1. In addition there is provided a movable contact 30 mounted in the case between shelves 28, 32 and 34 in the same manner as hereinbefore described. While return spring 26 is like that in FIG. 1, pushbutton 62 is a modified pushbutton which has a central flat portion 62*a* like portion in FIG. 12*a* in FIG. 1 but its lower portion is modified in that it has only one offset leg 62*c* similar to leg 12*c* in FIG. 1 but the other offset leg similar to 12*b* in FIG. 1 has been deleted as unnecessary. Push button 62 also has a reduced lower end portion 62*d* similar to portion 12*d* in FIG. 1 since no modification of that portion is necessary. Since this is a two-position selector switch, it is desirable to have pushbuttons 10 and 62 adjacent one another and, therefore, the space provided in case 4 for a third pushbutton has been filled by a plug 64. As shown in FIG. 10, this plug 64, has a wide flat upper portion 64*a* a narrow intermediate portion 64*b* that fits into the slot in the case and a slightly wider lower portion 64*c* that prevents withdrawal of the plug when the cover has been assembled.

One possible use or application of this two-position selector switch would be for starting and stopping an electrical device such as a motor. For this purpose, when pushbutton 62 is depressed normally open contact 40 is closed to establish a circuit between common terminal C and terminal 2 for motor starting purposes. The electrical current to the motor flows from terminal 66 through normally closed contact 42. Therefore, when it is desired to stop the motor, pushbutton 10 is depressed to open normally closed contact 42 thereby to disconnect power from the motor. It will be apparent that these two pushbuttons 10 and 62 are of the momentary type in that when the pushbutton is released after depression thereof, return springs 16 and 26 operate to return the pushbuttons to their normal positions. Such momentary switches are typical in motor control starting circuits because when the start button is depressed, this motor control circuit will establish a connection in shunt thereof so that the start pushbutton can then be released while the motor continues to be energized. However, the STOP normally closed contact is in series in the power circuit so that depression of pushbutton 10 will disconnect power despite the shunt connection across contact 40 thereby to stop the motor.

FIGS. 11–16 show a third version of the multiposition selector switch, that is, a three-position maintained selector switch, for example, having a HAND position, an AUTO and an OFF postion. As is well known in the art, operation of a switch to its HAND position preconditions the control device for hand or manual operation. Setting the selector switch to its AUTO position preconditions the control device for automatic operation. And, of course, depressing the off pushbutton, restores either the HAND or the AUTO pushbutton that may be in its operating position.

In the following description, reference characters like those used in FIGS. 1–10 will be used for like parts.

Figure 11:
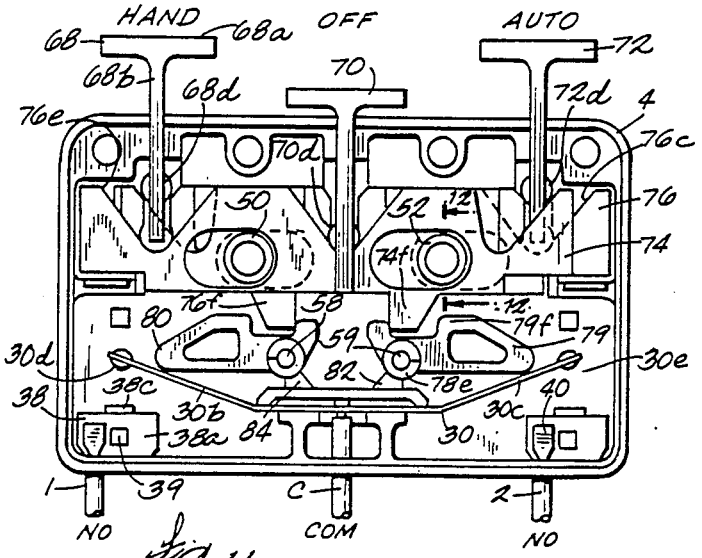

As shown in FIG. 11, this version of maintained selector switch is provided with a case 4 and a cover 48 like those in the first two versions of selector switch shown in FIGS. 1 and 8. This selector switch is also provided with a commmon terminal or wire C connected to movable contact 30 and two terminals or wires 1 and 2 connected to normally open stationary contacts 38 and 40, respectively. This switch has three like maintainable pushbuttons 68, 70 and 72, pushbutton 68 being depressible to close a first normally open contact 38, pushbutton 72 being depressible to alternatively close a second normally open contact 40 and OFF maintainable pushbutton 70 being depressible to restore either one of the other two pushbuttons to its undepressed position. It will be apparent that this is a maintained three-position selector switch where only one pushbutton may be depressed at a time. If a second pushbutton is depressed while a first pushbutton is being maintained in its depressed position, this first pushbutton will be restored to its undepressed position.

Figure 13:
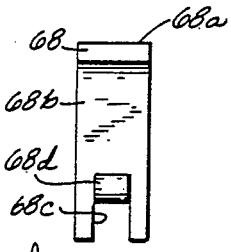

As shown in FIGS. 11 and 13, pushbutton 68 is generally T-shaped having an upper flat surface 68*a* for engagement by the finger of the user, a flat stem portion 68*b* extending downwardly therefrom, a slot 68*c* extending upwardly from its lower end to provide clearance for a pair of cam slides and a holding member hereinafter described and a cylindrical maintaining portion 68*d* at the upper end of slot 68*c* as shown in FIG. 13. Pushbuttons 70 and 72 are like pushbutton 68 so that they will not be further described.

This selector switch is also provided with movable contact operating means which includes pushbutton interlocking means that allows depression of only one pushbutton at a time and restores any operated pushbutton when another pushbutton is depressed. This means comprises a pair of cam slides 74 and 76 and a pair of movable contact actuating levers 79 and 80 as shown in FIG. 11. Cam slides 74 and 76 are alike but cam slide 76 is turned around 180 degrees, end for end, when it is assembled in the switch as shown in FIG. 1. In this manner, cam slide 74 will operate actuating lever 79 and cam slide 76 will operate actuating lever 80 as hereinafter more fully described.

Figure 14:
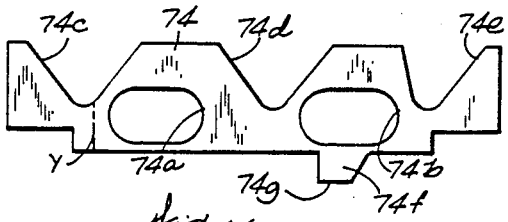

As shown in FIG. 14, cam slide 74 is provided with a pair of spaced oblong holes 74*a* and 74*b* whereby it is mounted on cylindrical projections 50 and 52 in case 4 as shown in FIG. 11, these oblong holes allowing cam slide 74 to move in the right-hand direction from the position shown in FIG. 11. Cam slide 74 is also provided with three V-slots 74*c*, 74*d* and 74*e* extending downwardly from its upper edge along the edges of which cam followers 68*d*, 70*d* and 72*d*, respectively, slide when a selected pushbutton is depressed or when cam slide 74 is moved in the right or left direction as hereinafter more fully described. Cam slide 74 is also provided with an actuator lug 74*f* extending down from its right-hand lower portion as shown in FIG. 14 for engaging lever 79 and pivoting it clockwise to close contacts 30*e* and 40. Cam slide 76 is like cam slide 74 except that it is turned as aforesaid so that its actuating lug 76*f* is at the lower left-hand portion thereof as shown in FIG. 11 for actuating lever 80.

Figure 15:
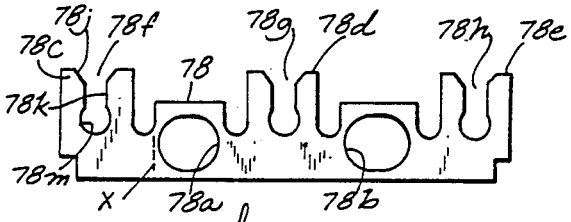

This selector switch is also provided with holding means for maintaining any depressed pushbutton in its depressed position. This holding means comprises a holding member 78 shown in FIG. 15 which is generally flat and has a pair of holes 78*a* and 78*b* whereby it is mounted onto cylindrical projections 50 and 52 in the case. As shown in FIG. 15, these holes 78*a* and 78*b* are slightly offround, that is, they have a slightly larger dimension in the horizontal direction then in the vertical direction to allow limited shifting of this holding member on cylindrical projections 50 and 52 for alignment with the three pushbuttons as hereinafter more fully described. This cam member 78 is also provided with three pairs of upstanding resilient fingers 78*c*, 78*d* and 78*e* with each pair of these upstanding fingers having a keyhole slot 78*f*, 78*g* and 78*h* therebetween. As shown in FIG. 15, keyhole slot 78*f* has a flared entry 78*j* at its upper end which continues downwardly into a pair of spaced parallel edges 78*k* terminating in a slightly enlarged round hole 78*m*. It will be apparent that this keyhole slot 78*f l is shaped and dimensioned to receive cylindrical portion 68d* of pushbutton 68 at its flared upper end whereafter the two fingers 78*c* are biasd apart as cylindrical portion 68*d* moves downwardly finally snapping into hole 78*m* where it is retained. Since fingers 78*c* are resilient, cylindrical portion 68*d* can also be forced upwardly out of hole 78*m* by an edge of one of the V-slots 74*c* or 76*e* depending upon whether pushbutton 72 or pushbutton 70 is depressed next. In response to such action, cylindrical portion 68*d* moves upwardly between parallel edges 78*k* and stops in flared entry 78*j*.

Figure 12:
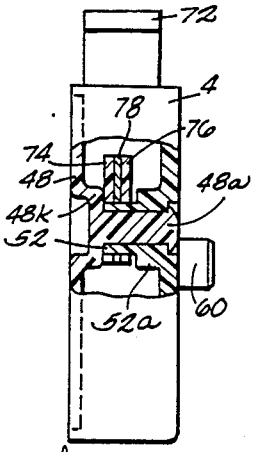

Cam slides 74 and 76 and holding member 78 are stacked in case 4 with cam slide 76 being inserted first followed by holding member 78 and then by cam slide 74 as shown in FIG. 12. Cylindrical projection 52 has a larger diameter 52*a* at its root as shown in FIG. 12 and pin 48*a* on the cover also has a larger diameter portion 48*k* at its root as shown in FIGS. 12 and 20 so that the stacked two cam slides 74 and 76 and holding member 78 which are flat are freely held between these larger diameter portions for limited sliding movement. The other projection 50 in the case and pin 48*b* in the cover are similarly formed for similar purposes.

Figure 16:
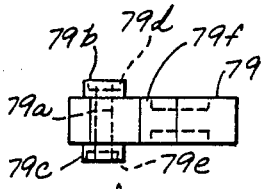

A top view of lever 79 is shown in FIG. 16. As shown therein, lever 79 has a traverse through-hole 79*a* adjacent its left-hand end whereby it is pivotally supported on pin 59 in the case as shown in FIG. 11. Lever 79 also has a pair of hubs 79*b* and 79*c* on opposite sides thereof through which hole 79*a* extends so that these hubs will space the active portion of the lever from the bottom of the case and from the cover to avoid interference therebetween. To provide a stop for limiting counterclockwise rotation of lever 79, hubs 79*b* and 79*c* are provided with symmetrical cutouts 79*d* and 79*e* so that cutout 79*d* will engage a boss 82 in the bottom of the case as shown in FIG. 11 thereby to limit counterclockwise pivotal rotation of lever 79 under the force of resilient contacting portion 30*c* of the movable contact to the angle shown in FIG. 11. Cutout 79*e* is provided in hub 79*c* on the opposite side of lever 79 so that a like part can be used for lever 80 at the left-hand portion of the selector switch shown in FIG. 11 and case 4 is provided with a similar boss 84 serving as a stop for the clockwise pivotal rotation of lever 80 under the force of resilient contacting portion 30*b* of the movable contact to substantially the angle shown in FIG. 11. Lever 79 is further provided with a bump 79*f* on its upper surface for engagement by the lug 74*f* as will be hereinafter described.

The selector switch of FIG. 11 operates as follows. As will be apparent, this switch is shown in FIG. 11 in its off position with OFF pushbutton 70 depressed and maintained in its depressed position by cylindrical portion 70*d* thereof being held in keyhole slot 78*g* of holding member 78. In this condition, both contacts 38 and 40 are normally open. To set the selector switch in one of its operating positions, pushbutton 72 is depressed. As a result, cylindrical portion 72*d* of pushbutton 72 bears against the angular edge of slot 74*e* and slides down therealong to move cam slide 74 in the right-hand direction until cylindrical portion 72*d* of the pushbutton is trapped in keyhole slot 78*h* of holding member 78. As cam slide 74 moves in the right-hand direction as aforesaid, the left-hand angular edge of V-slot 74*d* thereof bears against cylindrical portion 70*d* of OFF pushbutton 70 to restore the same to its up position. Also, when cam slide 74 is moved in the right-hand direction, its lug 74*f* engages bump 79*f* of lever 79 to pivot the same clockwise and bias movable contact tip 30*e* into closing engagement with stationary contact 40. In this position, lower edge 74*g* of lug 74*f* abuts the upper left portion of bump 79*f* to hold this lever in its clockwise operated position. Also cylindrical portion 72*d* of pushbutton 72 will be held in the lower end of keyhole slot 78*h* of holding member 78 to maintain contacts 30*e* and 40 closed until such time as another pushbutton is depressed.

If OFF pushbutton 70 is now depressed, the reverse action of that just described takes place. For this purpose, cylindrical portion 70*d* of pushbutton 70 will slide down the left-hand edge of the V-slot 74*d* to move slide cam 74 back to its left-hand position shown in FIG. 11. As a result, the right-hand angular edge of the V-slot 74*e* will restore pushbutton 72 to its up position shown in FIG. 11 and lug 74*f* will release lever 79 so that this lever will be pivoted back counterclockwise to its original position under the force resilient contacting portion 30*c* of the movable contact. As a result, the switch will be restored to its off position shown in FIG. 11.

If pushbutton 68 had been depressed next rather than OFF pushbutton 70, the action will be similar to that hereinbefore described in connection with depression of pushbutton 72 except that cam slide 76 will be moved in the left-hand direction while cam slide 74 remains in its original position. As a result, lug 76*f* will engage lever 80 and pivot it counterclockwise to close contacts 30*d* and 38. Cylindrical portion 68*d* of pushbutton 68 will now be retained in the lower end 78*m* of keyhole slot 78*f* of the holding member to maintain the contacts closed. The difference in this action is that since pushbutton 72 rather than 70 was down, the depression of pushbutton 68 will raise pushbutton 72 back to its normal position shown in FIG. 11. Thus, when pushbutton 68 is depressed, the right-hand angular edge of the V-slot 76*c* will bear against cylindrical portion 72*d* of pushbutton 72 to raise it out of the bottom of keyhole slot 78*h* up to its flared uppermost end.

From the foregoing it will be apparent that only one pushbutton can be pressed at a time and when a second pushbutton is depressed, the first one will be restored to its uppermost position.

Since the rear and forward edges of the pushbuttons are confined in the channels between the pairs of vertical ribs in the bottom of the case and on the cover as hereinbefore described in connection with FIGS. 1 and 8, it will be apparent that some slack between the parts is needed to avoid binding which, if it occurred, might prevent smooth operation of the pushbuttons. For this reason, holes 78*a* and 78*b* on holding member 78 shown in FIG. 15 are made slightly off-round, as hereinbefore described, in the horizontal direction to allow limited left or right shifting of this holding member to accurately align its keyhole slots with the cylindrical portions of the pushbuttons thereby to avoid the possibility of such binding which might affect smooth operation of the switch.

Figure 17:
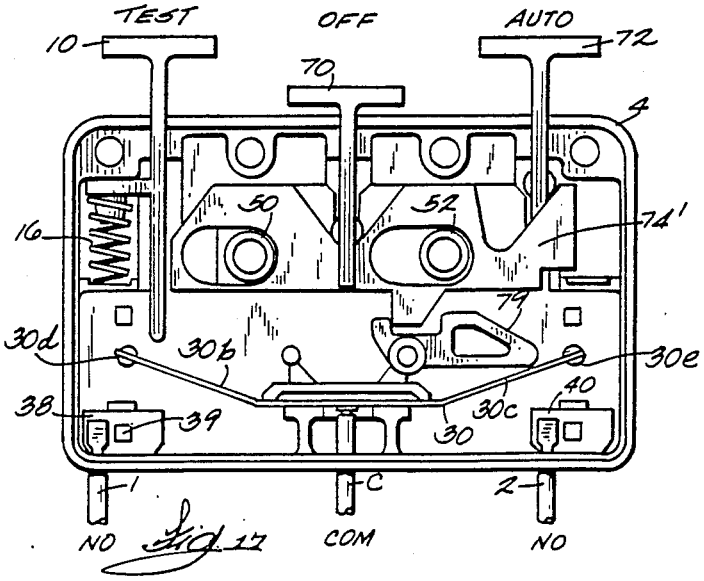
Figure 18:
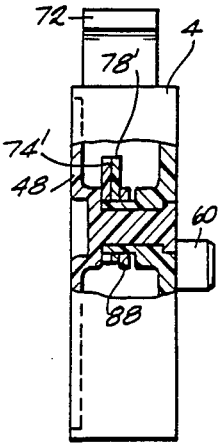

FIGS. 17 and 18 show a fourth version of the multi-positions selector switch, that is, a three-position selector switch which has a momentary contact and a maintained contact and which could be used for TEST-OFF-AUTO operation or the like. In FIGS. 17 and 18, reference characters like those used in the previous three versions of selector switch have been used for like parts. As shown in FIGS. 17 and 18, this version of selector switch is provided with a case 4 and cover 48 which is similar as those used in the other three versions. Also, this switch has a movable contact 30 and normally open stationary contacts 38 and 40 similar to those used in the versions of FIGS. 1 and 11 with stationary contact 40 being also used in the version of FIG. 8. Also, this version of selector switch has terminals or wires 1, 2 and C similar to those previously illustrated and described. This version has a momentary pushbutton 10 along with its bias spring 16 similar to those used in the versions of FIGS. 1 and 8. Also, this version of selector switch has maintained pushbuttons 70 and 72 similar to those shown in FIG. 11. Furthermore, this selector switch has a contact operating lever 79 like that shown in FIG. 11. This selector switch differs in its parts, however, in that it uses a holding member 78' which is like that shown in FIG. 15 except that the left-hand thereof has been cut off at the broken line x shown in FIG. 15 avoid interference with and to provide space for momentary pushbutton 10. Also, cam slide 74' is similar to cam slide 74 shown in FIG. 14 except that the left-hand end thereof has been cut off at broken line y shown in FIG. 14 to avoid interference with and to provide space for momentary pushbutton 10. Because the other cam slide 76 that is used in FIG. 11 is not used in this version of the switch, in order to allow use of the same case and cover, its space has been taken up by providing a pair of washer-like spacers behind holding member 78 such as spacer 88 shown in FIG. 18, this spacer having the same thickness as cam slide 76. From the foregoing, it will be apparent that pushbutton 10 operates in the same manner to close contacts 30*d* and 38 as hereinbefore described in connection with FIG. 1. Also maintained pushbuttons 70 and 72 operate cam slider 74' and lever 79 to close and reopen contacts 30*e* and 40 in the same manner as hereinbefore described in connection with FIG. 11.

While at least one example has heretofore been given as to the practical application and use of each of the four versions of multi-positioned selector switch described, it will apparent that they have a large number of other uses depending upon the type of system or circuit in which they are desired to be used.

While the apparatus hereinbefore described is effectively adapted to fulfill the objects stated, it is to be understood that the invention is not intended to be confined to the particular preferred embodiment of multiposition selector switch assembly means disclosed, inasmuch as it is susceptible of various modifications without departing from the scope of the appended claims.

We claim:

1. A kit of parts capable of being assembled into any one of a plurality of different versions of multi-position pushbutton selector switches comprising:

an insulating switch housing adapted to be used in each version;

a plurality of stationary contacts adapted to be mounted in said housing in a selected arrangement for connection to an external circuit;

a movable common contact comprising a main portion and first and second resilient contacting portions extending from said main portion, said common contact adapted to be mounted in said housing at said main portion whereby said resilient contacting portions are positioned for selectively contacting said stationary contacts; and switch operating means comprising a selected one of two interchangable contact actuator means adapted to be mounted in said housing for operating said first and second resilient contacting portions of said movable common contact into and out of engagement with respective ones of said stationary contacts, said interchangable contact actuator means comprising:

(a) first contact actuator means comprising a plurality of momentary pushbuttons and springs associated therewith adapted to be mounted in said housing whereby said springs bias said momentary pushbuttons to an extended position and said momentary pushbuttons are selectively depressible against said bias of said springs for directly operating said first and second resilient contacting portions of said movable common contact with respect to said stationary contacts so as to make or break desired momentary connections therebetween; or (b) second contact actuator means comprising movable contact actuating means adapted to be mounted in said housing for engaging at least one of said first and second resilient contacting portions, a plurality of maintainable pushbuttons adapted to be mounted in said housing whereby depression of a selected maintainable pushbuttons effects operation through said contact actuating means of at least one of said first and second resilient contacting portions of said movable common contact with respect to the corresponding stationary contact, and holding means effective to maintain the selected pushbutton in its depressed position.

2. The multi-position selector switch kit as claimed in claim 1, wherein:

said second contact actuator means also comprises:

one of said momentary pushbutton and a spring associated therewith adapted to be mounted in said housing whereby said spring biases said one momentary pushbutton to an extended position and said one momentary pushbutton is selectively depressible to operate the other of said resilient contacting portions of said movable contact with respect to the corresponding stationary contact to provide a combined momentary-maintained selector switch.

3. The multi-position selector switch kit as claimed in claim 1, wherein:

one of said maintainable pushbuttons is an OFF pushbutton;

and said movable contact actuating measn comprises means responsive to depression of said OFF pushbutton for causing restoration of said one resilient contacting portion of said movable contact and concurrently causing release of said selected pushbutton from said holding means and restoration of the same to its undepressed position.

4. The multi-position selector switch kit as claimed in claim 1, wherein:

said movable contact actuating means comprises:

elongated cam means;

means mounting said cam means for limited sliding movements perpendicular to movements of said maintainable pushbuttons within said housing;

inter-engaging means on said cam means and on said maintainable pushbuttons for causing sliding movement of said cam means when said selected maintainable pushbutton is depressed and for causing restoration to an undepressed position of all the other maintainable pushbuttons;

a lever mounted in said housing effective when actuated for operating said one resilient contacting portion of said movable contact;

a lug on said cam means for actuating said lever in response to said sliding movement of said cam means;

and said holding means comprises a holding member mounted in said housing for resiliently gripping and holding a selected maintainable pushbutton in its depressed position while allowing release of the depressed maintainable pushbutton therefrom by operation of said inter-engaging means when another pushbutton is depressed.

5. The multi-position selector switch kit as claimed in claim 4, wherein:

each of said maintainable pushbuttons comprises a one piece plastic molded member having an integrally molded transverse cylindrical portion thereon;

and said holding member comprises a pair of spaced resilient fingers for each said maintainable pushbutton having a keyhole slot therebetween with a flared entry at the free end thereof, said keyhole slot having parallel sides extending from said flared entry and terminating in a circular opening larger in diameter than the spacing of said parallel sides so that when said maintainable pushbutton is depressed said cylindrical portion thereof is guided by said flared entry between said parallel sides biasing them further apart and then snapping into said circular opening for retention therein until said depressed maintainable pushbutton is restored to an undepressed position by operation of said inter-engaging means when another one of said maintainable pushbuttons is depressed.

6. The multi-position selector switch kit as claimed in claim 21, wherein:

said plurality of momentary pushbuttons comprise:

a first momentary pushbutton for operating said first resilient contacting portion of said movable contact with respect to a first stationary contact so as to perform a circuit controlling function therebetween which restores under the bias of said associated spring when said first pushbutton is released;

and a second momentary pushbutton for operating said second resilient contacting portion of said movable contact with respect to a second stationary contact so as to perform a circuit controlling function therebetween which restores under the bias of said associated spring when said second pushbutton is released.

7. The multi-position selector switch kit as claimed in claim 6, wherein:

said housing has means for accommodating three momentary pushbuttons and respective springs associated therewith in linearly spaced relationship including upper and lower and middle pushbuttons;

said second momentary pushbutton is a middle pushbutton comprising an offset leg which reaches down to operate said second resilient contacting portion of said movable contact so as to have normally open START and normally closed STOP pushbuttons adjacent to one another in said housing;

and said means for accommodating said lower pushbutton has a plug filling the same in place of a pushbutton.

8. The multi-position selector switch kit as claimed in claim 6, wherein:

said plurality of momentary pushbuttons also comprise;

a third spring-biased pushbutton for operating said first and second resilient contacting portions concurrently with respect to said first and second stationary contacts so as to perform a dual circuit controlling function therebetween which restores under the bias of said associated spring when said third pushbutton is released.

9. The multi-position selector switch kit as claimed in claim 8, wherein:

said stationary contacts comprise:

normally closed stationary contacts associated with said first and second resilient contacting portions of said movable contact, respectively;

and means electrically connecting said normally closed stationary contacts to one another.

10. The multi-position selector switch kit as claimed in claim 9, wherein:

said first and second stationary contacts are normally open with respect to said first and second resilient contacting portions of said movable contact;

whereby selective depression of said first, second and third pushbuttons results in connecting respectively different pairs of said stationary contacts to said common movable contact.

11. The multi-position selector switch kit as claimed in claim 21, wherein:

said insulating switch housing is molded of plastic material and has a slot integrally molded in said housing having a retention lug therein and being configured to receive said main portion of said movable common contact with an interference fit;

and said main portion of said movable common contact being resilient so as to allow it to be flexed when inserted in said slot and having a notch for receiving said lug when said movable common contact is pressed into said slot to securely retain the same in place in said housing.

12. The multi-position sclector switch kit as claimed in claim 21, wherein:

said movable contact actuating means comprises:

a pair of like elongated cam slides reversely oriented for sliding movements on ON and OFF positions in said housing and having respective lugs thereon;

inter-engaging means on said cam slides and on first, second and third maintainable pushbuttons of said plurality thereof for causing sliding movements of said cam slides to opposite ON positions by respective depression of said first and second of said maintainable pushbuttons and to an OFF position by depression of said third maintainable pushbutton and for causing restoration to undepressed positions of the other two maintainable pushbuttons when one of said maintainable pushbuttons is depressed;

a pair of levers mounted in said housing operable by said reppective lugs when said cam slides are alternatively slid in opposite directions for actuating said resilient contacting portions of said movable contact into contact with respective stationary contacts;

detents on the respective maintainable pushbuttons;

and an elongated holding member mounted in said housing and having resilient holding fingers for receiving said detent of a depressed maintainable pushbutton for holding the same in its depressed position but allowing release thereof by operation of said inter-engaging means when another maintainable pushbutton is depressed.

13. The multi-position selector switch kit as claimed in claim 12, wherein:

said cam slides and said holding mexber are flat and stacked in said housing;

said housing comprises a pair of spaced mounting projections for said cam slides and said holding member;

said cam slides comprise respective pairs of spaced elongated holes through which said spaced projections extend to allow limited sliding movements of said cam slides in opposite directions;

and said holding member comprises a pair of holes through which said projections extend for mounting said holding member so that said holding fingers thereof are aligned with the respective pushbutton detents.

14. The multi-position selector switch kit as claimed in claim 13, wherein:

said projections are cylindrical and have respective reduced diameter intermediate portions for guiding said cam slides in their sliding paths.

15. The multi-position selector switch kit as claimed in claim 14, wherein:

said housing is provided with integrally molded channels for guiding the respective maintainable pushbuttons in their movements;

and said holes in said holding member are slightly wider than said mounting projections in a direction perpendicular to said maintainable pushbuttons to afford free alignment of said holding fingers with said pushbutton detents.

16. The multi-position selector switch kit as claimed in claim 12, wherein:

said levers also comprises holes near first ends thereof respectively;

said housing further comprises a pair of spaced integrally molded pins extending into said holes of said levers for pivotally supporting said levers in said housing so that the other ends of said levers actuate said first and second resilient contacting portions of said movable contact when said levers are operated by said respective lugs of said cam slides.

17. The multi-position selector switch kit as claimed in claim 16, wherein:

said housing comprises a pair of integrally molded stops;

and said levers comprises shoulders abutting the respective stops in the OFF position of said switch to limit the return movements of said levers to a point where said resilient contacting portions of said movable contact are slightly biased.

18. A kit of parts that can be assembled in various combinations within a housing to provide any one of a plurality of different versions of selector switches with some of the functional parts being mutually used in the different versions comprising:

an insulating switch housing adapted to be used in each version;

a plurality of stationary contacts adapted to be mounted in said housing in a selected arrangement;

terminals associated with said stationary contacts adatped to connect said stationary contacts to an external circuit;

a movable contact having a main portion at which it is adapted to be mounted in said housing and a common terminal adapted to connect said movable contact main portion to an external circuit, said movable contact further comprising first and second resilient contacting portions extending from said main portion for selectively contacting said stationary contacts so as to close and open electrical connections between said common terminal and said switched terminals;

and switch operating means adapted to be mounted in said housing comprising a selected one of two interchangeable contact actuator means including (a) first contact actuator means having three momentary pushbuttons including a lower pushbutton for actuating said first resilient contacting portion with respect to a first of said stationary contacts, an upper like pushbutton for actuating said second resilient contacting portion with respect to a second of said stationary contacts and a middle pushbutton having a pair of offset legs for actuating both said first and second resilient contacting portions with respect to said first and second stationary contacts concurrently, or (b) second contact actuating means having two momentary pushbuttons including a first pushbutton like said lower or upper pushbutton of said first contact actuator means, and a second pushbutton like said middle pushbutton of said first contact actuator means but having a single offset leg for actuating said secoud resilient contacting portion with respect to said second stationary contact.

19. A method of making either a two normally open and one normally closed contacts three-position momentary selector switch or a one normally closed and one normally open contact two-position momentary selector switch comprising:

providing a group of elements for assembling either said three-position or said two-position momentary selector switch, said elements comprising:

a molded electrically insulating case having means for mounting three pushbuttons with one pushbutton in the center position between the other two pushbuttons;

a cover adapted to be mounted to said case;

a movable common contact having a central mounting portion and first and second resilient contacting portions extending generally left and right from said central portion;

a pair of single-leg momentary pushbuttons each having a spring associated therewith;

a double-leg momentary pushbutton having a spring associated therewith;

two normally open stationary contacts;

and three normally closed stationary contacts with two of them connected together in spaced relation;

mounting said movable common contact at said central portion thereof in said case;

selecting from said group of elements said two normally open stationary contacts, said two normally closed connected-together stationary contacts, said pair of single-leg momentary pushbuttons and associated springs and said double-leg momentary pushbutton and associated spring for said three-position momentary selector switch and mounting the same in said case wherein said first and second resilient contacting portions normally engage said two normally closed connected-together stationary contacts, said single-leg momentary pushbuttons are individually depressible to directly move a respective one of said first and second resilient contacting portions from engagement with said normally closed stationary contacts to engagement with a respective one of said normally open stationary contacts, said double-leg momentary pushbutton is depressible for simultaneously directly moving both of said first and second resilient contacting portions from engagement with said normally closed stationary contact into engagement with both said normally open stationary contacts, and said respective springs cooperating with said case for biasing said respective momentary pushbuttons to an extended position with respect to said case, or selecting one of said normally open stationary contacts and said normally closed stationary contact which is not connected to another said normally closed stationary contact, one of said single-leg momentary pushbuttons and associated spring and said single-offset-leg momentary pushbutton and associated spring and mounting the same in said case with said single-offset-leg pushbutton in said center pushbutton mounting position wherein said first resilient contacting portion normally engages said normally closed stationary contact and said single-leg momentary pushbutton is depressible to directly move said first resilient contacting portion from said normally closed stationary contact, said single-offset-leg momentary pushbutton is depressible to directly move said second resilient contacting portion into engagement with said normally open stationary contact, and said respective springs cooperating with said case for biasing said respective momentary pushbuttons to an extended position with respect to said case; and assembling said cover on said case.

20. A method of making either a two normally open contacts three-positions maintained selector switch or a two normally open contacts one position momentary and two positions maintained selector switch comprising:

providing a group of elements for assembling either of said selector switches, said elements comprising:

a molded electrically insulating case having means for mounting three pushbuttons with one pushbutton in the center between the other two pushbuttons;

a cover adapted to be mounted to said housing;

a movable common contact having a central mounting portion and first and second resilient contacting portions extending generally left and right from said central portion;

three maintainable pushbuttons;

a momentary pushbutton and spring associated therewith;

two normally open stationary contacts;

a pair of three-position slide cams;

a two-position slide cam;

a pair of contact actuating levers;

a three-position holder for maintaining any one of three of said maintainable pushbuttons in depressed position;

and a two-position holder for maintaining either of two of said maintainable pushbuttons in depressed position;

mounting said movable common contact in said housing;

selecting from said group of elements said three maintainable pushbuttons, said two normally open stationary contacts, said pair of three-position slider cams, said pair of contact actuating levers and said three-position holder for said three-position maintained selector switch and mounting the same in said case wherein any one of two outermost ones of said maintainable pushbuttons are depressible for moving at least one of said slider cams for engaging a respective one of said levers for moving said first and second resilient contacting portions into engagement with a respective one of said normally open stationary contacts, a center pushbutton of said three pushbuttons is depressible for moving at least one of said slider cams for returning said respective lever to a position releasing said resilient contacting portion from said normally open stationary contact, and said holding means is positioned to releasably grip a respective depressed maintainable pushbutton for maintaining that pushbutton depressed until another of said pushbuttons is depressed or selecting said momentary pushbutton and associated spring, two of said maintainable pushbuttons, said two normally open stationary contacts, said two-position slider cam, one of said contact actuating levers and said two-position holder and mounting the same in said case wherein said momentary pushbutton is depressible to directly move said first resilient contacting portion into engagement with a respective one of said normally open stationary contacts, said spring is cooperable with said case to bias said momentary pushbutton to its extended position with respect to said case for releasing said first resilient contacting portion from said respective one of said normally open stationary contacts, said maintainable pushbuttons are alternately depressible for moving said slide cam for engaging and releasing, respectively, said lever for moving said second resilient contacting portion into and out of engagement respectively with the other of said normally open stationary contacts, and said holding means is positioned to releasably grip a respective depressed maintainable pushbutton for maintaining that pushbutton depressed until the other maintaining pushbutton is depressed;

and assembling said cover on said case.

* * * * *